US008490416B2

(12) United States Patent
Nemer et al.

(10) Patent No.: US 8,490,416 B2
(45) Date of Patent: Jul. 23, 2013

(54) METHOD OF COOLING A METAL STRIP TRAVELING THROUGH A COOLING SECTION OF A CONTINUOUS HEAT TREATMENT LINE, AND AN INSTALLATION FOR IMPLEMENTING SAID METHOD

(75) Inventors: Maroun Nemer, Fontenay Sous Bois (FR); Maria Zoghaib, Antony (FR); Denis Clodic, Paris (FR); Diala Abdo, Saint Mande (FR); Stéphane Langevin, Saint Fargeau-Ponthierry (FR); Patrick Dubois, Andrezel (FR)

(73) Assignee: CMI SA, Seraing (BE)

( * ) Notice: Subject to any disclaimer, the term of this patent is extended or adjusted under 35 U.S.C. 154(b) by 1056 days.

(21) Appl. No.: 12/434,112

(22) Filed: May 1, 2009

(65) Prior Publication Data

US 2010/0218516 A1 Sep. 2, 2010

(30) Foreign Application Priority Data

Mar. 2, 2009 (FR) ..... 09 00924

(51) Int. Cl.

| | |
|---|---|
| ***F25D 13/06*** | (2006.01) |
| ***F25D 17/02*** | (2006.01) |
| ***C09K 5/00*** | (2006.01) |
| ***C09K 5/04*** | (2006.01) |
| ***F28D 15/00*** | (2006.01) |

(52) U.S. Cl.
USPC ..... 62/64; 62/63; 252/67; 165/104.17

(58) Field of Classification Search
USPC ..... 62/63, 64; 165/104.17; 252/67
See application file for complete search history.

(56) References Cited

U.S. PATENT DOCUMENTS

| | | | | |
|---|---|---|---|---|
| 3,036,440 | A * | 5/1962 | Feinman | 62/64 |
| 3,605,427 | A * | 9/1971 | Rudy | 2/64 |
| 3,728,869 | A | 4/1973 | Schmidt | |
| 4,000,625 | A * | 1/1977 | Beerens et al. | 62/63 |
| 4,399,658 | A | 8/1983 | Nielsen | |
| 4,481,782 | A * | 11/1984 | Mukerjee | 62/63 |
| 4,517,814 | A * | 5/1985 | Rothstein | 62/374 |
| 4,528,819 | A * | 7/1985 | Klee | 62/63 |
| 4,934,445 | A | 6/1990 | Plata et al. | |
| 5,390,900 | A * | 2/1995 | Ginzburg | 266/113 |
| 5,714,083 | A * | 2/1998 | Turner | 252/68 |

(Continued)

FOREIGN PATENT DOCUMENTS

| | | |
|---|---|---|
| DE | 44 29 203 | 2/1996 |
| EP | 0343103 A1 | 11/1989 |

(Continued)

*Primary Examiner* — Marc Norman
*Assistant Examiner* — Filip Zec
(74) *Attorney, Agent, or Firm* — Muncy, Geissler, Olds & Lowe, PLLC

(57) ABSTRACT

The invention relates to a method of cooling a metal strip traveling through a cooling section in a continuous heat treatment line. In accordance with the invention, the method consists in projecting a refrigerant medium into the cooling section (4) onto the surface of the strip (1) to be cooled, the medium being constituted for the most part by a phase-change substance that passes into the gaseous phase at a temperature that is lower than the temperature of the strip (1) and without oxidizing said strip so that energy is exchanged within an endothermic process by a change in the phase of said phase-change substance.

18 Claims, 1 Drawing Sheet

U.S. PATENT DOCUMENTS

| | | | | |
|---|---|---|---|---|
| 5,902,543 | A | 5/1999 | Plata et al. | |
| 5,961,885 | A * | 10/1999 | Eaton et al. | 252/390 |
| 6,054,095 | A | 4/2000 | Minato | |
| 6,305,176 | B1 * | 10/2001 | Matsuda et al. | 62/63 |
| 6,460,742 | B1 * | 10/2002 | Fuenders et al. | 222/590 |
| 2001/0025495 | A1 * | 10/2001 | Newman et al. | 62/63 |
| 2002/0112497 | A1 * | 8/2002 | Patel et al. | 62/259.2 |
| 2003/0029176 | A1 * | 2/2003 | Thomas et al. | 62/63 |
| 2006/0277927 | A1 * | 12/2006 | Brahmbhatt | 62/64 |

FOREIGN PATENT DOCUMENTS

| | | | |
|---|---|---|---|
| EP | 1655383 | A1 | 5/2006 |
| FR | 2796965 | | 2/2001 |
| JP | 2170925 | A | 7/1990 |

* cited by examiner

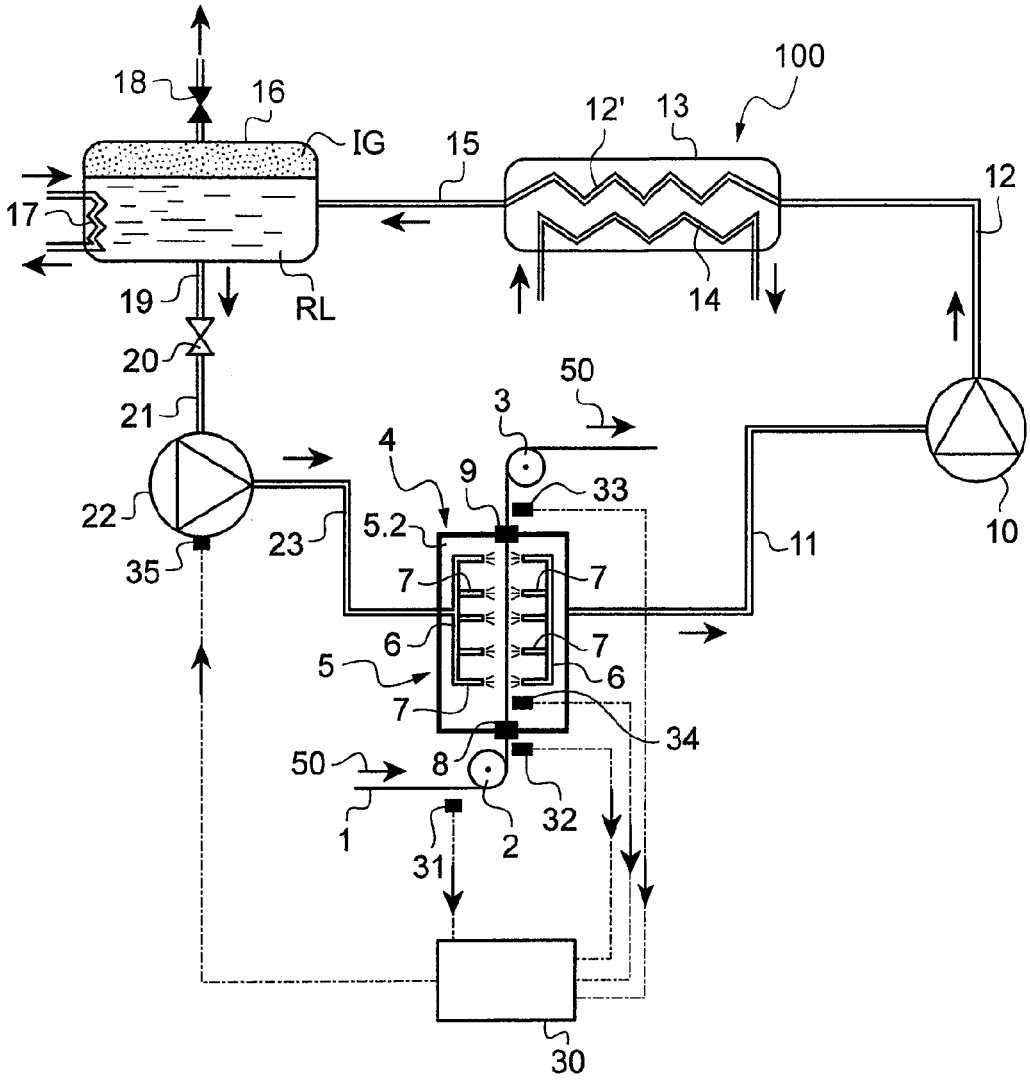
100
18
16
IG
15
12'
13
12
17
19
RL
14
20
21
50
3
4
9
33
22
5.2
23
11
10
35
7
7
6
7
5
6
7
34
50
8
32
1
2
31
30

METHOD OF COOLING A METAL STRIP TRAVELING THROUGH A COOLING SECTION OF A CONTINUOUS HEAT TREATMENT LINE, AND AN INSTALLATION FOR IMPLEMENTING SAID METHOD

BACKGROUND OF THE INVENTION

The present invention relates to cooling a metal strip traveling through a cooling section in a continuous heat treatment line, such as an annealing line or a line for applying a metal or an organic coating.

In continuous heat treatment lines of the above-mentioned type, metal strips are cooled in a cooling section by blowing a gas, generally a mixture of nitrogen and hydrogen, through one or more cooling boxes that are fitted with associated holes or blow tubes.

A constant concern of designers of cooling sections lies in cooling the strip traveling through said section as uniformly as possible, while simultaneously avoiding giving rise to instabilities and/or vibration in the traveling strip.

Document EP-A-1 655 383 discloses such a cooling device, in which a strip travels between two cooling boxes fitted with blow tubes inclined at an angle that is directed upstream and/or downstream relative to the traveling strip, and also towards the edges thereof. As the strip passes through the cooling section, it is thus cooled on both faces by the blown-in mixture of gas that is at a temperature lower than the temperature of the strip. The pressure needed for blowing is provided by one or two associated fans. The gas mixture that is heated by heat exchange with the strip is cooled in a heat exchanger, generally a water heat exchanger, so as to be transferred subsequently to a cooling system via the fan(s), thus being recirculated to the cooling boxes.

It is known that heat transfer depends on the blowing distance between the strip and the outlet orifices for the gas mixture, and also on the geometrical configuration of the blowing and the speed of the blowing. It is known that heat transfer is more effective when the blowing distance is small and/or the blowing speed is high. Nevertheless, there are practical limits on increasing the blowing speed and on reducing the distance between the strip and the blowing system, since beyond a certain threshold vibration and/or oscillation of the strip appears, and that can lead to the strip coming into contact with the blowing system, thereby leading to marks that are incompatible with the desired surface quality, and possibly even damaging the strip more severely.

In a variant to the technique of blowing a gas mixture, water has also been used as a cooling fluid, as disclosed in document EP-A-0 343 103, in which the strip is cooled rapidly by means of nozzles delivering a water/air mist, or in a variant as disclosed in FR-A-2 796 965 in which water/nitrogen nozzles are used.

The use of water as a cooling fluid is advantageous insofar as heat transfer requires lower outlet speeds for the cooling fluid, since transfer is based on exchanging heat by evaporating the water into air or nitrogen, however that technique presents two major drawbacks. The first drawback is that heat transfer is limited by the saturation temperature of water in the incondensable air or nitrogen gas, and the second drawback is that steel at high temperature inevitably suffers oxidation when cooled by a mist of water and air or of water and nitrogen, which means that it is subsequently necessary to perform special treatment for removing an oxide film, where such treatment can be expensive and sometimes even impossible to perform on certain lines such as galvanizing lines.

There thus exists a need for a cooling method that provides better performance, being capable of significantly increasing the speed at which a traveling metal strip is cooled, but without that setting the strip into vibration and/or oscillation, and without causing said strip to oxidize.

OBJECT OF THE INVENTION

An object of the invention is to devise a cooling method and installation that enable a traveling metal strip to be cooled at a high speed of cooling without generating vibration and/or oscillation, and while avoiding any need for oxide removal or special surface treatment after cooling, as would be necessary if the surface of the strip were to be subjected to oxidation to a greater or lesser extent.

GENERAL DEFINITION OF THE INVENTION

The above-mentioned technical problem is solved in accordance with the invention by a method of cooling a metal strip traveling through a cooling section in a continuous heat treatment line, the method consisting in projecting a refrigerant medium into the cooling section onto the surface of the strip to be cooled, the medium being constituted for the most part by a phase-change substance that passes into the gaseous phase at a temperature that is lower than the temperature of the strip and without oxidizing said strip, so that energy is exchanged within an endothermic process by a change in the phase of said phase-change substance.

By using an endothermic process with phase change, a large amount of energy is transferred in a manner that depends little on the speed of blowing, thereby making it possible to avoid the above-mentioned risk of setting the metal strip that is being cooled into vibration and/or oscillation. Naturally, the amount of energy transferred depends on the type of refrigerant medium used, and above all on the quantity blown in, and thus on the quantity evaporated or sublimed as a result of the phase change that takes place in the vicinity of the surface of the strip. Furthermore, the above-mentioned drawbacks of the prior art using water as a cooling fluid are avoided.

In a particular implementation of the method of the invention, the refrigerant medium is in solid form, in particular in the form of flakes, presenting a triple point that is higher than the temperature of the outside ambient medium, the endothermic process taking place with said refrigerant medium subliming at the surface of the strips to be cooled.

In another implementation of the method of the invention, the refrigerant medium is a fluid, in particular in the form of fine droplets, presenting a normal boiling temperature that is higher than the temperature of the outside ambient medium, the endothermic process taking place with said refrigerant medium evaporating at the surface of the strip to be cooled.

In practice, the use of a refrigerant fluid appears to be preferable, not only in terms of performance, but also for greater ease of implementing and controlling the associated installation.

Preferably, the normal sublimation or boiling temperature of the refrigerant medium is close to the temperature of the outside ambient medium, so that said refrigerant medium can be recondensed at a pressure close to atmospheric pressure.

Advantageously, the sublimed refrigerant solid or the evaporated refrigerant fluid is recovered downstream from the cooling section so as to be recirculated, being subjected to a condensation and separation process at the end of which an incondensable fraction is isolated, said fraction being controlled to adjust the condensation temperature of the refrigerant fluid or solid in order to minimize energy consumption.

When using a refrigerant fluid, it is preferable for said refrigerant fluid to comprise at least 80% by volume of the phase-change fluid.

It is then advantageous for the phase-change fluid to be pentane. The pentane may be in the pure state, or in a variant in a pentane/hexane mixture at a ratio of 80/20 by molar percentage.

Also preferably, the atmosphere in the cooling section is isolated from the outside ambient medium, in particular at the inlet and the outlet for the strip to be cooled, thereby enabling the refrigerant medium to be under continuous control during the endothermic process. This is important not only for reasons of expense, but also for reasons of safety, insofar as certain fluids suitable for use as the refrigerant can be flammable at high temperature, and therefore must not be mixed with oxygen from the air.

Finally, and advantageously, the mass flow rate of the refrigerant medium projected onto the surface of the strip is controlled so as to remain below a predetermined limit so as to ensure that all of the refrigerant medium is involved in the change of phase.

The invention also provides an installation for implementing a method presenting at least one of the above-specified characteristics.

In accordance with the invention, the installation comprises:

- a cooling section comprising a cooling box having the strip for cooling passing therethrough in leaktight manner, said box being fitted internally with nozzles arranged to project a refrigerant medium onto both faces of said strip, the medium being composed for the most part by a phase-change substance;
- a condenser connected downstream from the cooling box via a blower;
- a cylinder forming a tank and a separator, connected downstream from the condenser; and
- a recirculation pump connected downstream from the tank and separator cylinder via a safety valve, and connected to the upstream end of the cooling box.

Provision can be made for the nozzles of the cooling box to be arranged with segmentation so as to be able to track a predetermined cooling slope as a function of the travel speed of the strip.

Provision can also be made for the cooling box to have an upstream section free from nozzles and a downstream section fitted with nozzles, upstream and downstream being relative to the travel direction of the strip, said upstream section being fitted with a sensor for measuring the temperature of the strip entering into said box.

In accordance with another advantageous characteristic, the cooling box is fitted at the inlet and the outlet for the strip with leaktight through airlocks.

It is also advantageous to make provision for the installation to include sensors for measuring the temperature of the strip upstream from the inlet to and downstream from the outlet from the cooling box, said sensors serving to regulate the flow rate of the recirculation pump as a function of the travel speed of said strip, which travel speed is measured by an associated sensor outside said cooling box.

Also advantageously, the tank and separator cylinder is fitted internally with a refrigerating coil operating at a temperature that is lower than the condensation temperature of the refrigerant medium used in order to finish off the condensation and separation processes between the liquid phase of the refrigerant medium and the incondensable gases inside said cylinder. In particular, the tank and separator cylinder is fitted with a vent enabling the incondensable gases to be extracted.

Other characteristics and advantages of the invention appear more clearly in the light of the following description relating to a particular embodiment and given with reference to the accompanying drawing that shows an installation for implementing the method.

BRIEF DESCRIPTION OF THE DRAWING

Reference is made to FIG. 1, which is a diagram showing an installation for implementing the method of the invention.

DETAILED DESCRIPTION OF A PREFERRED EMBODIMENT OF THE INVENTION

FIG. 1 is a diagram showing an installation referenced 100 for implementing the cooling method in accordance with the invention. A metal strip referenced 1 travels through a cooling section referenced 4 in a continuous heat treatment line that may be an annealing line or a line for applying a metal or an organic coating.

In accordance with the technological background, the line along which the strip 1 passes is determined by a bottom deflector roller 2 and a top deflector roller 3 on either side of the cooling section 4, with the travel direction of the strip 1 being represented by arrows 50.

The cooling section 4 comprises a cooling box 5 through which the strip 1 for cooling passes. The cooling box 5 is closed and the strip passes in leaktight manner through inlet and outlet airlocks 8 and 9 that are shown diagrammatically. They may be constituted by systems of flaps optionally cooperating with bearing rollers, as is well known in the field of continuous treatment lines. By means of the inlet and outlet airlocks 8 and 9, it is ensured that the atmosphere that exists inside the cooling section 4 is isolated from the external ambient medium, in particular at the inlet and at the outlet for the strip for cooling, thereby enabling the refrigerating medium to be controlled continuously during cooling of said strip.

The cooling box 5 is fitted internally with projection manifolds 6 arranged on either side of the plane along which the strip passes, each manifold itself being provided with a plurality of nozzles 7 enabling a particular refrigerating medium to be projected inside the cooling section 4 onto the surface of the strip 1 for cooling.

In accordance with an essential characteristic of the invention, provision is made to project onto the strip a refrigerant medium that is made up for the most part of a phase-change substance that converts to the gas phase at a temperature lower than the temperature of the strip, and that does so without oxidizing said strip, so that energy is exchanged in an endothermic process with said phase-change substance changing phase.

The fact that cooling is caused by changing the phase of at least one component of the refrigerant medium means that cooling depends little on the projection speed, which is advantageous for ensuring that the strip travels in stable manner, since the risk of vibration and/or oscillation appearing in said strip is reduced. Furthermore, the drawbacks of prior techniques that make use of water as the cooling liquid are eliminated (where said drawbacks are oxidation of the strip and the need to provide subsequent treatment to remove the oxide).

In a first embodiment, the refrigerant medium is in solid form, in particular in the form of fine flakes, presenting a triple point at a temperature that is higher than the temperature of the outside ambient medium, the endothermic process taking place with said refrigerant medium subliming at the surface of the strip for cooling. For example, it is possible to use $CO_2$.

Nevertheless, taking $CO_2$ specifically as an example, which sublimes at −78° C. at atmospheric pressure assuming that the atmosphere is constituted entirely by $CO_2$ in the cooling section, or at temperatures that are much lower when the $CO_2$ is at a partial pressure lower than atmospheric pressure, there is generally a need for a high compression ratio in order to organize recirculation of the refrigerant medium, which can be disadvantageous in terms of energy consumption.

That is why it is often preferable to use a different implementation of the method in which the refrigerant medium is a fluid, in particular in the form of fine droplets, presenting a normal boiling temperature that is higher than the temperature of the outside ambient medium, the endothermic process taking place with said refrigerant medium evaporating at the surface of the strip to be cooled.

Preferably, the refrigerant medium used should have its normal sublimation or boiling temperature close to the temperature of the outside ambient medium, so that said refrigerant medium can be recondensed at a pressure close to atmospheric pressure.

In general, it is advantageous to make provision for the sublimed solid refrigerant or the evaporated fluid refrigerant to be recovered downstream from the cooling section 4 in order to be recirculated, being subjected to a condensation and separation process at the end of which an incondensable fraction is isolated, said fraction being controlled to adjust the condensation temperature of the solid or fluid refrigerant in order to minimize energy consumption.

In accordance with an advantageous characteristic, a refrigerant fluid is used that comprises at least 80% by volume of phase-change fluid.

The use of pentane as the fluid or as the phase-change component of the fluid appears to be particularly advantageous in this respect.

It is possible to use pentane in the pure state, in particular liquid pentane that evaporates at 35° C. at its own vapor pressure, i.e. at ambient pressure.

In a variant, it is possible to use a mixture comprising a majority of pentane, preferably with at least 80% by volume of pentane.

It is possible to envisage mixtures such as mixtures of pentane and nitrogen, however using such mixtures leads to an overall energy cost that is still somewhat penalizing because of pentane evaporating into an incondensable gas, thereby limiting the latent heat of evaporation as a function of the partial pressure of pentane in nitrogen.

In contrast, a pentane/hexane mixture at a ratio of 80/20 by molar percentage appears to be much more advantageous. Such a mixture begins to evaporate at 39.5° C. and is completely in the gaseous state at 43° C.

It will be understood that pentane presents a particular advantage resulting from its normal boiling temperature being about 35° C., since, in order to condense pentane, it suffices to organize heat exchange in a suitably dimensioned heat exchanger that exchanges heat with an external fluid (air or water).

More generally, the mass flow rate of the refrigerant medium that is projected onto the surface of the strip is preferably controlled so as to remain below a predetermined limit, so that all of the refrigerant medium is involved in the change of phase.

In order to obtain a uniform distribution of the refrigerant fluid for evaporation at the surface of the strip, and in order to ensure that all of the refrigerant fluid is evaporated, use is made in particular of spray nozzles such as the nozzles 7 that are arranged to spray the fluid in fine droplets over the entire surface of the strip so as to obtain uniform heat transfer with a mass flow rate that is low and with it being particularly simple to regulate the quantity of heat that is to be absorbed. It is then advantageous to provide for the quantity of heat that is to be exchanged to be controlled by the mass flow rate of the sprayed fluid.

The above description naturally also applies to a refrigerant medium in solid form, where it is appropriate to ensure that the entire refrigerant medium sublimes as a result of being projected, e.g. as fine flakes, onto the entire surface of the strip.

In practice, with a refrigerant fluid, it is preferable to use spray nozzles that deliver flat cones. The droplets striking the two faces of the strip are then subjected instantaneously to a change of phase, giving rise to a large amount of energy being absorbed.

The mass flow rate at which the refrigerant fluid that evaporates is injected also naturally depends on the number of spray nozzles that are used and on the mass flow rate of each of them. The geometrical distribution of the spray nozzles depends on the angle over which they act, which angle is selected to ensure that the droplets impact against the entire cooling surface. On this topic, reference can be made to document EP-A-1 655 383, which contains useful teaching on how spray tubes should be inclined, it being understood that that prior document relates solely to cooling by blowing a conventional gaseous medium such as a mixture of nitrogen and hydrogen. Provision could also be made for the spray nozzles to be arranged in segmented manner, so as to be able to track a predetermined cooling slope as a function of the travel speed of the strip.

Returning to the sole FIGURE of the accompanying drawing, it can be seen that the installation 100 also has a condenser 13 connected downstream from the cooling box 5, via a blower 10 and respective pipes 11 and 12. The pipe 12, essentially containing a vapor phase, is extended by a segment 12' in the condenser 13, which condenser is implemented in this example in the form of a conventional heat exchanger using an exchange circuit 14 that conveys water or air. The outlet pipe 15 from the condenser 13 terminates at a cylinder 16 forming a tank and a separator. Both a liquid phase and incondensables penetrate together into the cylinder 16, with these two phases separating into a liquid supply RL surmounted by a gaseous incondensable fraction IG.

At the outlet from the cylinder 16 forming a tank and a separator, there is a pipe 19 leading to a safety valve 20, and then a pipe 21 leading to a recirculation pump 22 that is connected to the upstream end of the cooling box 5 by a pipe 23.

Thus, after the phase-change fluid sprayed into the cooling section has evaporated, the fluid is condensed in the external condenser 13 and, downstream from said condenser, the incondensables present in the refrigerant fluid are controlled, which incondensables are typically nitrogen, possibly with traces of hydrogen.

It should be observed that the cooling box 5 shown has an upstream section 5.1 without any nozzles 7, and a downstream section 5.2 that is fitted with nozzles 7, where "upstream" and "downstream" are here relative to the travel direction 50 of the strip 1. The upstream section 5.1 is fitted with a sensor 34 that serves to measure the temperature of the strip 1 entering into said box. Because there are no nozzles there, it is possible to measure the temperature of the strip optically, and thereby to ensure that all of the refrigerant medium is indeed transformed into gas. Any droplet that is not subjected to phase change will flow into this section where it will be evaporated, or sublimed if it is a flake.

The installation also includes sensors 32 and 33 for measuring the temperature of the strip 1, respectively upstream from the inlet to and downstream from the outlet from the cooling box 5. These sensors 32 and 33 serve to regulate the flow rate of the recirculation pump 22 as a function of the travel speed of said strip, which travel speed is measured by an associated sensor 31 outside the cooling box 5.

A controller unit 30 is shown diagrammatically that receives the information provided by the speed sensor 31 and by the temperature sensors 32, 33, 34, this information being conveyed via a wired network, as represented by chain-dotted lines. This controller unit 30 serves to deliver very precise operating instructions to the control member 35 of the recirculation pump 22.

It can also be seen in the FIGURE that the cylinder 16 constituting a tank and a separator is fitted internally with a cooling coil 17 making use of its own refrigerant fluid, which fluid operates naturally at a temperature that is lower than the condensation temperature of the phase-change refrigerant medium used for cooling the strip. This cooling coil 17 acts inside the cylinder 16 to finish off the processes of condensing and separating the liquid phase of the refrigerant medium from the incondensable gases. It is important to control the quantity of incondensable gases in the refrigerant fluid since that serves to adjust its condensation temperature: the lower the content of incondensables, the lower the condensation temperature of the phase-change fluid.

Provision could also be made for a vent 18 from the top of the cylinder 16 for the purpose of extracting the incondensable gases therefrom. This makes it possible to avoid incondensables accumulating while the installation is in operation, which would affect its efficiency in the long run. The cooling coil 17 typically operates at a temperature of 15K to guarantee more thorough condensation of the phase-change refrigerant fluid and to obtain the desired separation. It is then certain that the incondensables accumulating in the cooling section are indeed separated from the working refrigerant fluid, and that all of the fluid for pumping to the spray nozzles 7 is indeed in the liquid state.

The safety valve 20 serves to stop the flow of the refrigerant medium in an emergency, such as a massive ingress of air, or in the event of malfunction of any of the elements of the circuit, the strip no longer moving, etc. The liquid refrigerant fluid is pumped by the recirculation pump 22 so as to be delivered directly of the spray nozzles 7 in order to repeat the cycle.

As described above, the flow rate of the recirculation pump 22 is regulated by a controller (the unit 30) that relies on input data concerning the temperatures of the strip at the inlet and the outlet of the cooling enclosure, and also relating to the travel speed of the strip. This data enables the system to be controlled effectively, since the quantity of heat that needs to be extracted from the strip is naturally a function of its travel speed and of the setpoint temperature at the outlet of the strip, and also of the temperature difference between the inlet and the outlet of the cooling enclosure. This quantity of heat thus determines the flow rate of the pump, and thus the quantity of refrigerant fluid sprayed onto the strip.

The sealing airlocks 8 and 9 forming parts of the cooling box 5 are particularly when pentane is used, as mentioned above, not only for questions of expense (that would be true with any type of cooling fluid), but above all for reasons of safety. Pentane, like other potentially-suitable analogous fluids, is flammable at high temperature (309° C. for pentane), and therefore must be not mixed with oxygen in the air. The composition of pentane within the box is therefore measured continuously and controlled so as to be well above its upper limit for igniting in air. In this respect, it is advantageous to maintain the cooling box at a small positive pressure. Provision could also be made for an additional probe to monitor the percentage of oxygen in the atmosphere within the cooling box.

Furthermore, in order to optimize the energy consumption of the blower 10, the work it performs is regulated by the temperature of the refrigerant fluid in the heat exchanger constituted by the condenser 13. At a pressure higher than atmospheric pressure, the saturation temperature of the gases increases. For refrigerant, with pentane at a pressure of 1.15 bars, the saturation temperature increases up to 40° C. Depending on the temperature of the refrigerant fluid in the heat exchanger, the cooling fluid is compressed so that the temperature difference between the pentane and the cooling water or air at the outlet from the heat exchanger is appropriate and so that the phase-change refrigerant fluid is completely condensed at the outlet. The temperature of the cooling air or water needs typically to be controlled to a temperature 3K to 5K below the normal boiling temperature of the refrigerant fluid, which for pentane is 35° C., thereby ensuring that, after evaporation, the pentane can be transferred to the condenser 13 merely by means of a blower 10 with the energy consumption of the system being minimal compared with using a compressor.

This enables particularly effective cooling to be implemented with energy being transferred quickly in a manner that depends little on the spraying speeds, while avoiding any risk of oxidation that would require subsequent oxide removal.

Implementing such an endothermic process with a phase change in the context of cooling a traveling metal strip thus presents considerable progress compared with traditional cooling techniques making use of a gaseous mixture such as a mixture of nitrogen and hydrogen, or above all a water/air or water/nitrogen mist, which makes it impossible to avoid oxidation of the strip, and therefore requires sufficient oxide removal treatment to be provided.

Furthermore, by a suitable choice of phase-change substances, particularly by choosing a refrigerant fluid having its normal boiling temperature slightly higher than the temperature of the ambient medium, it is possible to optimize the energy consumption of the system as a whole.

The invention is not limited to the embodiment described, but on the contrary covers any variant using equivalent means to reproduce the above-specified essential characteristics.

What is claimed is:

1. A method of cooling a metal strip traveling through a cooling section in a continuous heat treatment line, wherein the method consists in projecting a refrigerant medium into the cooling section (4) onto a surface of the strip (1) to be cooled, the medium being constituted by a phase-change substance that passes into the gaseous phase at a temperature that is lower than the temperature of the strip (1) and without oxidizing said strip so that energy is exchanged within an endothermic process by a change in the phase of said phase-change substance, wherein the refrigerant medium is a fluid, in particular in the form of fine droplets, presenting a normal boiling temperature that is higher than the temperature of the outside ambient medium, the endothermic process taking place with said refrigerant medium evaporating at the surface of the strip (1) to be cooled and wherein the normal sublimation temperature of the refrigerant medium is equal or inferior up to 5 K to the temperature of the outside ambient medium, so that said refrigerant medium can be recondensed at a pressure equal to atmospheric pressure.

2. The method according to claim 1, wherein, the phase-change substance comprising pentane.

3. The method according to claim 1, wherein the refrigerant medium is in solid form, in particular in the form of flakes, presenting a triple point that is higher than the temperature of the outside ambient medium, the endothermic process taking place with said refrigerant medium subliming at the surface of the strips (1) to be cooled.

4. The method according to claim 3, wherein the sublimed refrigerant solid is recovered downstream from the cooling section (4) so as to be recirculated, being subjected to a condensation and separation process at the end of which an incondensable fraction is isolated, said fraction being controlled to adjust the condensation temperature of the refrigerant solid in order to minimize energy consumption.

5. The method according to claim 1, wherein the normal boiling temperature of the refrigerant medium is equal or inferior up to 5 K to the temperature of the outside ambient medium, so that said refrigerant medium can be recondensed at a pressure equal to atmospheric pressure.

6. The method according to claim 1, wherein the evaporated refrigerant fluid is recovered downstream from the cooling section (4) so as to be recirculated, being subjected to a condensation and separation process at the end of which an incondensable fraction is isolated, said fraction being controlled to adjust the condensation temperature of the refrigerant fluid in order to minimize energy consumption.

7. The method according to claim 1, wherein the refrigerant fluid comprises at least 80% by volume of the phase-change fluid.

8. The method according to claim 7, wherein the refrigerant fluid is pentane in the pure state.

9. The method according to claim 7, wherein the refrigerant fluid is a pentane/hexane mixture at a ratio of 80/20 by molar percentage.

10. The method according to claim 4, wherein the atmosphere in the cooling section (4) is isolated from the outside ambient medium, in particular at an inlet and an outlet for the strip (1) to be cooled, thereby enabling the refrigerant medium to be under continuous control during the endothermic process.

11. The method according to claim 4, wherein the mass flow rate of the refrigerant medium projected onto the surface of the strip (1) is controlled so as to remain below a predetermined limit so as to ensure that all of the refrigerant medium is involved in the change of phase.

12. An installation for cooling a metal strip traveling through a cooling section in a continuous heat treatment line, wherein the installation comprises:

a cooling section (4) comprising a cooling box (5) having the strip (1) for cooling passing therethrough in leaktight manner, said box being fitted internally with nozzles (7) arranged to project the refrigerant medium onto both faces of said strip, the medium being composed by a phase-change substance that passes into the gaseous phase at a temperature that is lower than the temperature of the strip (1) and without oxidizing said strip so that energy is exchanged within an endothermic process by a change in the phase of said phase-change substance;

a condenser (13) connected downstream from the cooling box (5) via a blower (10);

a cylinder (16) forming a tank and a separator, connected downstream from the condenser (13); and a recirculation pump (22) connected downstream from the tank and separator cylinder (16) via a safety valve (20), and connected to the upstream end of the cooling box (5), wherein the normal sublimation temperature of the refrigerant medium is equal or inferior up to 5 K to the temperature of the outside ambient medium, so that said refrigerant medium can be recondensed at a pressure equal to atmospheric pressure.

13. The installation according to claim 12, wherein the nozzles (7) of the cooling box (5) are arranged with segmentation so as to be able to track a predetermined cooling slope as a function of the travel speed of the strip.

14. The installation according to claim 12, wherein the cooling box (5) has an upstream section (5.1) free from nozzles (7) and a downstream section (5.2) fitted with nozzles (7), upstream and downstream being relative to the travel direction (50) of the strip (1), said upstream section (5.1) being fitted with a sensor (34) for measuring the temperature of the strip (1) entering into said box.

15. The installation according to claim 12, wherein the cooling box (5) is fitted at the inlet and the outlet for the strip (1) with leaktight through airlocks (8, 9).

16. An installation according to claim 12, including sensors (32, 33) for measuring the temperature of the strip (1) upstream from the inlet to and downstream from the outlet from the cooling box (5), said sensors serving to regulate the flow rate of the recirculation pump (22) as a function of the travel speed of said strip, which travel speed is measured by an associated sensor (31) outside said cooling box.

17. The installation according to claim 12, wherein the tank and separator cylinder (16) is fitted internally with a refrigerating coil (17) operating at a temperature that is lower than the condensation temperature of the refrigerant medium used in order to finish off the condensation and separation processes between the liquid phase of the refrigerant medium and the incondensable gases inside said cylinder.

18. The installation according to claim 17, wherein the tank and separator cylinder (16) is fitted with a vent (18) enabling the incondensable gases to be extracted.

* * * * *